United States Patent [19]

Enever

[11] 4,384,903

[45] May 24, 1983

[54] SLURRY EXPLOSIVE COMPOSITION

[75] Inventor: James A. Enever, Kilmarnock, Scotland

[73] Assignee: Imperial Chemical Industries Limited, London, England

[21] Appl. No.: 201,972

[22] Filed: Oct. 29, 1980

[30] Foreign Application Priority Data

Nov. 5, 1979 [GB] United Kingdom ..... 7938177

[51] Int. Cl.[3] ..... C06B 45/34

[52] U.S. Cl. ..... 149/7; 149/2; 149/21; 149/41; 149/60; 149/61; 149/112; 264/3 C; 264/3 E

[58] Field of Search ..... 149/2, 7, 21, 60, 61, 149/41, 112; 264/3 C, 3 E

[56] References Cited

U.S. PATENT DOCUMENTS 4,055,449 10/1977 Wasson ..... 149/60 X
4,084,994 4/1978 Nielson et al. ..... 149/2
4,265,406 5/1981 Palgrave et al. ..... 264/3 D

FOREIGN PATENT DOCUMENTS 1544937 11/1967 France ..... 149/2
1171404 5/1967 United Kingdom ..... 149/2

*Primary Examiner*—Stephen J. Lechert, Jr.
*Attorney, Agent, or Firm*—Cushman, Darby & Cushman

[57] ABSTRACT

An aqueous slurry explosive blasting composition comprising an aqueous suspension of water-soluble crystalline oxidizing salt consisting predominantly of ammonium nitrate, which salt has been comminuted in a saturated aqueous solution in the presence of a water-soluble crystal-growth inhibiting surfactant having a hydrophobic portion and a hydrophilic portion in its molecule, in intimate admixture with liquid water-immiscible hydrocarbon fuel sensitizer. The surfactant maintains the oxidizer salt in a finely divided state and also ensures that the liquid hydrocarbon remains uniformly distributed throughout the explosive mass as a stable coating of droplets on the salt particles thereby enhancing the explosive sensitivity of the composition. The preferred fuel is diesel oil and preferred surfactants include sodium carboxymethyl cellulose, long chain aliphatic amines, polyacrylic acids, sulphonated nuclear aromatic compounds, sulphonated dyes, sulphonated polymers and long chain alcohol sulphonates and phosphonates.

17 Claims, No Drawings

SLURRY EXPLOSIVE COMPOSITION

This invention relates to improved aqueous slurry explosive compositions of the kind containing oxidising salt and water-immiscible hydrocarbon sensitising fuel and to a method of preparing such compositions.

Slurry explosives generally comprise inorganic oxidising salt, a liquid solvent, disperser or carrier for said salt and fuel. The oxidising salt is usually predominantly ammonium nitrate but often contains a proportion of nitrates or perchlorates of sodium, potassium or calcium. The liquid, which is present in sufficient quantity to form a continuous phase, generally contains water although non-aqueous slurries are also known. The chemical constitution of the liquid phase may vary widely but usually contains dissolved oxidising salt, thickener and optionally other modifying ingredients such as cross-linking agents and aeration agents. Although such explosives are termed 'slurry' explosives the consistency and viscosity of the compositions may vary widely, ranging for example, from pourable compositions to highly viscous extrudable gels. Slurry explosive compositions are widely used in commercial blasting operations because they are safe, relatively cheap, propagate at high density and can be used in wet conditions.

Fuel is required in slurry explosive compositions to combine with the oxygen from the oxidising salt and thereby enhance the power and sensitivity of the composition. Certain fuels, for example, flaked aluminium and self-explosive materials such as trinitrotoluene are especially effective sensitisers and are widely used. Both these types of sensitising fuels are expensive and, being solids, present handling difficulties in the manufacture of slurry explosives, particularly in mixing operations which require metering and pumping of the ingredients and the finished composition. There has, therefore, been a tendency to replace solid sensitisers with liquid sensitising materials. However, in order to achieve sufficient sensitivity for reliable propagation in small diameter, self-explosive liquid sensitisers such as methylamine nitrate and ethylene glycol mononitrate have been required. Such sensitisers are also costly and somewhat hazardous. The search has therefore continued to find methods of using cheap, safe fuels as sensitisers in slurry explosives.

Liquid hydrocarbon fuels, particularly diesel oil (fuel oil) has been extensively used as a sensitiser in ammonium nitrate/fuel oil (ANFO) blasting agents, the oil being applied as a coating on the surface of the ammonium nitrate particles. Attempts to use fuel oil as sensitiser in slurry explosives have been less successful as it is difficult to disperse the oil in sufficiently fine droplets throughout the liquid phase of the slurry and the droplets tend to coalesce on storage with resulting rapid loss in sensitivity. Some success has been achieved by the use of emulsifying agents to emulsify the fuel oil with water in the aqueous phase, preferably as a water-in-oil emulsion. However, the resulting compositions will only propagate in large diameter (>7.5 cm) unless the composition contains auxiliary sensitiser.

In a method described in U.S. Pat. No. 4,055,449 improved fuel oil sensitised aqueous slurry explosive is prepared by dispersing fuel oil in hot concentrated ammonium nitrate solution containing crystal habit modifier and allowing the solution to cool. Long needle-like ammonium nitrate crystals are formed as a matrix which inhibits migration and coalescence of the dispersed oil droplets. Slurry explosive compositions prepared by this method are still significantly less sensitive than ANFO explosive and their preparation involves the undesirable handling of hot ammonium nitrate solution.

It is an object of this invention to provide more sensitive aqueous slurry explosives sensitised with water immiscible liquid hydrocarbon fuel which can be prepared by mixing the ingredients at ambient temperature.

U.S. Pat. No. 4,265,406 describes the preparation of aqueous suspensions of comminuted oxidising salt. These suspensions were especially advantageous for the preparation of slurry explosive compositions at ambient temperature because they could be handled in the same manner as liquids without segregation of the salt particles. The method of preparation involved comminution of the oxidising salt in the presence of a saturated solution of the salt and also in the presence of a crystal-growth inhibitor. We have now discovered that when the oxidising salt comprises predominantly ammonium nitrate and the crystal growth inhibitor is a surfactant having a hydrophobic and a hydrophilic portion in its molecule, superior liquid hydrocarbon fuel-sensitised slurry explosives can be prepared by intimately mixing the fuel into the aqueous ammonium nitrate suspension at ambient temperature. Aqueous suspensions further containing a deflocculant as described in our copending United Kingdom patent application No. 79,32303 to prevent increase in viscosity of the aqueous suspensions on storage may also be used in the preparation.

Thus in accordance with this invention an aqueous slurry blasting explosive composition comprises an aqueous suspension of water-soluble crystalline oxidising salt consisting predominantly of ammonium nitrate, which salt has been comminuted in a saturated aqueous solution of said salt in the presence of a water-soluble surfactant which is a crystal-growth inhibitor for ammonium nitrate and has a hydrophobic portion and a hydrophilic portion in its molecule, in intimate admixture with liquid water-immiscible hydrocarbon fuel sensitiser. The aqueous suspension should contain sufficient water to maintain a continuous fluid phase, the amount being preferably in the range from 10 to 40% by weight of the suspension.

We believe that the superior explosive properties of the slurry explosive of this invention is attributable to the liquid fuel droplets becoming anchored on the surface of the ammonium nitrate by the surfactant, the hydrophilic molecular portions linking to surfaces of ammonium nitrate which are newly formed during the comminution and the hydrophobic portions linking to the droplets of hydrocarbon fuel. The hydrocarbon fuel is thereby maintained as a stable outer layer in intimate association with the surfaces of the ammonium nitrate particles and has a sensitising activity similar to that of the oil coating of ANFO explosives. The surfactant acts in the composition both to maintain the oxidiser salt in a finely divided state and also to ensure that the liquid hydrocarbon remains uniformly distributed throughout the explosive mass as a stable coating of droplets on the salt particles, and both of these functions enhances the explosive sensitivity of the composition. Thus from another aspect the invention consists in an aqueous slurry blasting explosive composition comprising an aqueous phase having in suspension therein finely comminuted particles of ammonium nitrate coated with a crystal-growth inhibiting surfactant comprising hydrophilic and hydrophobic molecular portions and further coated with droplets of liquid hydrocarbon fuel, which droplets are bound to the ammonium nitrate particles by the surfactant.

The invention also includes a method of preparing an aqueous slurry blasting explosive comprising the steps of comminuting water-soluble crystalline oxidising salt consisting predominantly of ammonium nitrate in a saturated aqueous solution of oxidising salt in the presence of a crystal-growth inhibiting surfactant having a hydrophobic portion and a hydrophilic portion in its molecule to form an aqueous suspension of comminuted oxidising salt and intimately mixing liquid water-immiscible hydrocarbon fuel sensitiser into the suspension. The process is carried out at a temperature below that at which all the oxidiser salt dissolves in the solution and is advantageously carried out at ambient temperature.

The comminution step may conveniently be carried out in a ball-mill and the subsequent incorporation of the hydrocarbon fuel may conveniently be carried out by means of a high-shear mixer such as a high speed revolving blade mixer.

The oxidising salt is preferably comminuted to average particle diameter of less than 45 microns, and more preferably to average particle diameter of 5 to 20 microns.

The slurry explosive composition conveniently contains from 6 to 20% by weight of water and from 30 to 80% by weight of oxidising salt.

The slurry explosives may if desired include modifying ingredients such as thickeners and gassing agents, and also additional oxidising salt or fuel. In general it is economically advantageous to incorporate about 40 to 60 parts by weight of aqueous suspension of comminuted oxidising salt into the composition and to add ordinary grade prilled ammonium nitrate to the suspension. Also it is not usually possible to incorporate all the fuel required for oxygen balance in the form of liquid hydrocarbon fuel coated on the comminuted salt and it is convenient to balance the composition with additional fuel such as atomised aluminium.

The liquid hydrocarbon fuel may comprise, for example, benzene, toluene, xylene or fuel oil but the preferred fuel is diesel oil (No. 2 Fuel Oil). The liquid hydrocarbon fuel is conveniently present in an amount in the range from 1 to 12% by weight of the composition, preferably in the range from 1.5 to 5% of the composition.

The crystal-growth inhibiting surfactants suitable for this invention include:

water-soluble polysaccharide derivatives, for example, sodium carboxymethyl cellulose (SCMC); long chain aliphatic amines wherein the aliphatic group preferably contains from 6 to 18 carbon atoms; polyacrylic acids; sulphonated nuclear aromatic compounds, for example, sodium methyl naphthalene sulphonate; sulphonated dyes, for example, acid magenta; sulphonated polymers, for example, sodium lignosulphonate; long chain (C6 to C18) alkyl sulphonates and phosphonates; and mixtures of any two or more of these surfactants.

When deflocculants are used to prevent increase in viscosity of the oxidiser salt suspension on storage the preferred deflocculants include water-soluble polysaccharide derivatives, for example, sodium carboxymethyl cellulose, polyacrylic acids, polyvinyl pyrrolidone, sodium lignosulphonate and salts, preferably the sodium salt, of condensates of naphthalene sulphonic acid with formaldehyde. Mixtures of any two or more of these deflocculants may be used if desired. It will be noted that some of the materials which are effective deflocculants are also effective crystal-growth inhibitors and in these cases, the preferred crystal-growth inhibitors should be added first, followed by the other chemical acting as a deflocculant. The time between one addition and the other should be sufficient to allow the crystal-growth inhibitor to adsorb on the crystal surface. In all cases the chemical nature of the deflocculant should be different from that of the crystal-growth inhibitor. Preferred inhibitor/deflocculant combinations include sodium methyl naphthalene sulphonate/SCMC; sodium methyl naphthalene sulphonate/sodium salt of a condensate of naphthalene sulphonic acid with formaldehyde; SCMC/sodium salt of a condensate of naphthalene sulphonic acid with formaldehyde; acid magenta/sodium salt of a condensate of naphthalene sulphonic acid with formaldehyde and sodium methyl naphthalene sulphonate/sodium lignosulphonate.

The concentration of the crystal-growth inhibiting surfactant and the deflocculant may vary within wide limits depending on the desired particle size and phase volume of oxidiser salt in the aqueous suspension. In general, the amount of each of the surfactant and deflocculant should preferably be in the range from 0.05 to 2.0% of the total weight of the comminuted oxidising salt.

The invention is further illustrated by the following Examples wherein all parts and percentages are quoted by weight.

In the Examples ammonium nitrate particles which originally had average particle size of about 500 microns were ground in a stainless steel ball mill having a capacity of 5 liters. The mill dimensions were:

Internal diameter—175 mm
External diameter—203 mm
Internal length—193 mm
External length—286 mm 200 stainless steel balls each 25 mm diameter were used. Using a set of motor driven rollers, the mill was rotated at a maximum speed of about 90 rpm and minimum speed of 60 rpm, the maximum corresponding to 83% of the critical speed (centrifuging speed).

EXAMPLE 1

84 parts of ammonium nitrate, 1.0 part of sodium carboxymethyl cellulose surfactant, having molecular weight of about 100,000 and degree of substitution of 0.7, and 16 parts of water were milled for 30 minutes to give an aqueous suspension of surfactant coated ammonium nitrate with an average particle diameter of 20 microns (after storage for one month the particle size was 25 microns). The discrete particles had adsorbed all the SCMC.

A slurry explosive having the following composition was prepared in a Lodige-Morton high speed revolving plough mixer at 15° C. using the prepared aqueous suspension of coated ammonium nitrate.

| | Parts |
|---|---|
| Suspension of surfactant coated ammonium nitrate | 58 |
| Prilled ammonium nitrate | 33 |
| No. 2 Fuel Oil | 3 |
| Atomised aluminium | 5 |
| Guar Gum (thickener) | 0.5 |
| Zinc chromate (cross-linker) | 0.2 |
| Sodium nitrite solution (20% in | |

-continued

| | Parts |
|---|---|
| water) (gassing agent) | 0.3 |

When tested unconfined at a density of 1.25 g/ml in 85 mm diameter cartridges at 5° C. this explosive detonated when primed with 35 g of Pentolite (50/50 pentaerythritol tetranitrate/trinitrotoluene). The explosive power (weight strength) measured by the Ballistic Mortar test was 81% Blasting Gelatine.

EXAMPLE 2

84 parts ammonium nitrate, 0.25 parts of sodium methyl naphthalene sulphonate surfactant and 16 parts of water were milled for 45 minutes. 1.0 part sodium carboxymethyl cellulose (as used in Example 1) was then added to act as deflocculant and milling was continued for a further 45 minutes. This gave a suspension with an average particle size of 10 microns (which remained unchanged after storage for 1 month), wherein the particles were coated with the surfactant.

A slurry explosive having the following composition was prepared in a Lodige-Morton mixer at 15° C. using the prepared aqueous suspension of ammonium nitrate.

| | Parts |
|---|---|
| Suspension of surfactant coated ammonium nitrate | 43.5 |
| Prilled ammonium nitrate | 43.5 |
| Fuel Oil | 1.7 |
| Atomised aluminium | 9.8 |
| Guar Gum | 0.6 |
| Zinc chromate | 0.4 |
| Sodium nitrite solution (20 % in water) | 0.5 |

When tested unconfined at a density of 1.32 g/ml in 85 mm diameter cartridges at 5° C. this explosive detonated when primed with 15 g of Pentolite. The explosive power (weight strength) measured by the Ballistic Mortar test was 88% Blasting Gelatine.

EXAMPLE 3

84 parts of ammonium nitrate, 0.5 parts of sodium carboxymethyl cellulose surfactant (as used in Example 1), 0.5 parts sodium salt of naphthalene sulphonic acid/formaldehyde condensate (deflocculant) and 16 parts of water were milled for 120 minutes. This gave a suspension with an average particle size of 10 microns (which remained unchanged after storage for 1 month), each particle being coated with the surfactant and deflocculant.

A slurry explosive having the following composition was prepared in a Lodige-Morton mixer at 15° C. using the prepared aqueous suspension of ammonium nitrate.

| | Parts |
|---|---|
| Suspension of surfactant coated ammonium nitrate | 45 |
| Prilled ammonium nitrate | 45 |
| Fuel oil | 3 |
| Atomised aluminium | 5.5 |
| Guar Gum | 0.6 |
| Zinc chromate | 0.4 |
| Sodium nitrite solution | |

-continued

| | Parts |
|---|---|
| (20% in water) | 0.5 |

When tested unconfined at a density of 1.47 g/ml in 85 mm diameter cartridges at 5° C. this explosive detonated when primed with 12 g of pentolite. The explosive power (weight strength) measured by the Ballistic Mortar was 81% Blasting Gelatine.

EXAMPLE 4

84 parts of ammonium nitrate, 0.25 parts of sodium methyl naphthalene sulphonate surfactant and 16 parts of water were milled for 90 minutes. The resultant aqueous suspension contained ammonium nitrate particles having an average particle diameter of 15 microns. The viscosity of the suspension at 20° C. measured by Brookfield Viscometer using Spindle 4 at 20 rpm was 8,500 centipoises.

A slurry explosive having the following composition was prepared using the prepared aqueous ammonium nitrate suspension:

| | Parts |
|---|---|
| Suspension of surfactant coated ammonium nitrate | 87.76 |
| Fuel oil | 1.5 |
| Aluminium granules | 10.0 |
| Guar gum | 0.4 |
| Sodium dichromate | 0.2 |
| Thiourea | 0.2 |
| Sodium nitrite solution (20% in water) (gassing agent) | 0.1 |

In preparing the explosive composition the sodium dichromate crosslinking agent and the gassing agent were added to a previously prepared mixture of the remaining ingredients just before the final composition was pumped into an 83 mm diameter borehole. After remaining 5 minutes in the borehole, during which time the explosive became aerated and the thickening agent became crosslinked, the explosive was successfully detonated when primed with 30 g of Pentolite.

EXAMPLE 5

84 parts of ammonium nitrate, 0.25 parts of sodium methyl naphthalene sulphonate surfactant and 16 parts of water were milled for 45 minutes. 0.5 parts of SCMC and 0.5 parts of sodium lignosulphonate were then added as deflocculants and milling was continued for a further 45 minutes. The resultant aqueous suspension contained ammonium nitrate particles having an average particle diameter of 15 microns. The viscosity of the suspension at 20° C. measured by Brookfield Viscometer using Spindle 4 at 20 rpm was 2,000 centipoises.

A slurry explosive having the same composition as Example 4 but using the aqueous ammonium nitrate suspension of this Example was prepared and tested in an 83 mm diameter borehole as described in Example 4. The explosive was successfully detonated when primed with 30 g of Pentolite.

EXAMPLE 6

82.5 parts of ammonium nitrate, 0.5 parts acid fuschine (ex BDH Chemicals) and 17 parts water were milled for 90 minutes. The resultant aqueous suspension contained ammonium nitrate particles having an average particle size of 20 microns and had a viscosity of 1500 centipoises.

A slurry explosive having the following composition was prepared using the above suspension of ammonium nitrate in a Lodige-Morton mixer at 20° C.

| | Parts |
|---|---|
| Ammonium nitrate suspension | 50 |
| Prilled ammonium nitrate | 40 |
| Atomised aluminium | 5 |
| Fuel oil | 3 |
| Guar gum | 0.3 |
| Zinc chromate | 0.1 |
| Thiourea | 0.2 |
| Sodium nitrite solution (20% in water) | 0.05 |

A 250 g sample tested unconfined at a density of 1.35 g/ml in 85 mm cartridges at 20° C. detonated when primed with 12 g of Pentolite. The explosive power (weight strength) measured by the Ballistic Mortar test was 80% Blasting Gelatine.

EXAMPLE 7

76.7 parts of ammonium nitrate, 9.9 parts of calcium nitrate, 13.1 parts of water and 0.3 parts of primary amine acetate salt Armac T (ex Akzo Chemie) were milled for 90 minutes. The resultant aqueous suspension contained ammonium nitrate and calcium nitrate having an average particle size of 40 microns and had a viscosity of 7000 centipoises.

A slurry explosive having the following composition was prepared using the above suspension.

| | Parts |
|---|---|
| Ammonium nitrate/calcium nitrate suspension | 50 |
| Atomised aluminium | 5 |
| Fuel Oil | 3 |
| Guar Gum | 0.3 |
| Zinc Chromate | 0.1 |
| Thiourea | 0.2 |
| Sodium nitrite solution (20% in water) | 0.05 |

A 250 g sample was tested unconfined at a density of 1.35 g/ml in an 85 mm cartridge at 20° C. detonated when primed with 12 g of Pentolite. The explosive power (weight strength) measured by the Ballistic Mortar test was 81% Blasting Gelatine.

EXAMPLE 8

82.2 parts of ammonium nitrate, 17 parts of water, 0.3 parts of Armac T and 0.5 parts of sodium salt of naphthalene sulphonic acid/formaldehyde condensate, Belloid SFD (ex Ciba-Geigy) were milled for 90 minutes. The resultant aqueous suspension contained ammonium nitrate particles having an average particle size of 30 microns and had a viscosity of 750 centipoises.

A slurry explosive having the same composition as in Example 6 was prepared using the suspension as prepared above.

A 250 g sample tested unconfined at a density of 1.43 g/ml in an 85 mm cartridge at 20° C. detonated when primed with 12 g of Pentolite. The explosive power (weight strength) measured in the Ballistic Mortar test was 80% Blasting Gelatine.

EXAMPLE 9

82 parts of ammonium nitrate, 17 parts of water 0.5 parts SCMC (as in Example 1) and 0.5 parts Belloid SFD were milled for 90 minutes. The resultant aqueous suspension contained ammonium nitrate particles having an average particle size of 40 microns and had a viscosity of 550 centipoises.

A slurry explosive having the same composition as in Example 6 was prepared using the suspension as prepared above.

A 250 g sample tested unconfined at a density of 1.38 g/ml in an 85 mm cartridge at 20° C. detonated when primed with 12 g of Pentolite. The explosive power (weight strength) measured by the Ballistic Mortar test was 82% Blasting Gelatine.

EXAMPLE 10

82.5 parts of ammonium nitrate, 17 parts of water and 0.5 parts sodium lignosulphonate, Wanin S (ex Steetly Chemicals) were milled for 90 minutes. The resultant aqueous suspension contained ammonium nitrate particles having an average particle size of 100 microns and had a viscosity of 1200 centipoises.

A slurry explosive having the same composition as in Example 6 was prepared using the suspension as prepared above.

A 250 g sample tested unconfined at a density of 1.44 g/ml in an 85 mm cartridge at 20° C. detonated when primed with 35 g of Pentolite. The explosive power (weight strength) measured by the Ballistic Mortar test was 81% Blasting Gelatine.

EXAMPLE 11

82.5 parts of ammonium nitrate, 15 parts of water, 2.5 parts of an aqueous solution of polyacrylamide Versicol W 13 (ex Allied Colloids) containing 20% by weight of polyacrylamide were milled for 90 minutes. The resultant aqueous suspension contained ammonium nitrate particles having an average particle size of 100 microns and had a viscosity of 1200 centipoises.

A slurry explosive having the same composition as in Example 6 was prepared using the suspension as prepared above.

A 250 g sample tested unconfined at a density of 1.32 g/ml in an 85 mm cartridge at 20° C. detonated when primed with 35 g of Pentolite. The explosive power (weight strength) measured by the Ballistic Mortar test was 81% Blasting Gelatine.

EXAMPLE 12

82.5 parts of ammonium nitrate, 16.5 parts water and 0.25 parts of sodium methyl naphthalene sulphonate were milled for 45 minutes. 0.25 parts of polyvinyl pyrrolidone and 0.5 parts Belloid SFD were then added and milled for a further 45 minutes. The resultant aqueous suspension contained ammonium nitrate particles having an average particle size of 30 microns and had a viscosity of 500 centipoises.

A slurry explosive having the same composition as Example 6 was prepared using the suspension as prepared above.

A 250 g sample was tested unconfined at a density of 1.46 g/ml in an 85 mm cartridge at 20° C. detonated when primed with 12 g of Pentolite. The explosive power (weight strength) measured by the Ballistic Mortar test was 80% Blasting Gelatine.

EXAMPLE 13

82.5 parts ammonium nitrate, 16 parts water and 0.25 parts sodium methyl naphthalene sulphonate were milled for 45 minutes. 1.25 parts of an aqueous solution of polyacrylic acid Versicol E 16 (ex Allied Colloids) containing 25% by weight of polyacrylic acid was then added and milling continued for a further 45 minutes. The resultant aqueous suspension contained ammonium nitrate particles having an average particle size of 30 microns and had a viscosity of 2000 centipoises.

A slurry explosive having the same composition as in Example 6 was prepared using the suspension as prepared above.

A 250 g sample tested unconfined at a density of 1.41 g/ml in an 85 mm cartridge at 20° C. detonated when primed with 12 g of Pentolite. The explosive power (weight strength) measured by the Ballistic Mortar test was 82% Blasting Gelatine.

EXAMPLE 14

80 parts of ammonium nitrate, 19 parts water, 0.5 parts SCMC and 0.5 parts Belloid SFD were milled for 90 minutes. The resultant aqueous suspension contained ammonium nitrate particles having an average particle size of 13 microns and had a viscosity of 770 centipoises.

A slurry explosive having the following composition was prepared using the above suspension of ammonium nitrate.

| | Parts |
|---|---|
| Ammonium nitrate suspension | 50 |
| Prilled ammonium nitrate | 30.3 |
| Sodium nitrate | 5 |
| Atomised aluminium | 10 |
| Xylene | 4 |
| Guar gum | 0.3 |
| Pregelatinised starch | 1.0 |
| Zinc chromate | 0.2 |
| Thiourea | 0.2 |
| Sodium nitrite solution (20% in water) | 0.2 |

A 250 g sample tested unconfined at a density of 1.21 g/ml in an 85 mm cartridge at 20° C. detonated when primed with 12 g of Pentolite. The explosive power (weight strength) measured by the Ballistic Mortar test was 79% Blasting Gelatine.

EXAMPLE 15

80 parts of ammonium nitrate, 19 parts water, 0.5 parts SCMC (as in Example 1) and 0.5 parts Belloid SFD were milled for 90 minutes. The resultant aqueous suspension contained ammonium nitrate particles having an average particle size of 13 microns and had a viscosity of 770 centipoises.

A slurry explosive having the following composition was prepared using the above suspension of ammonium nitrate.

| | Parts |
|---|---|
| Ammonium nitrate suspension | 50 |
| Prilled ammonium nitrate | 30.5 |
| Sodium nitrate | 5 |
| Atomised aluminium | 7 |
| Xylene | 7 |
| Guar gum | 0.3 |
| Pregelatinised starch | 1.0 |
| Zinc chromate | 0.2 |
| Thiourea | 0.2 |

A 250 g sample tested unconfined at a density of 1.42 g/ml in an 85 mm cartridge at 20° C. detonated when primed with 12 g of Pentolite. The explosive power (weight strength) measured by the Ballistic Mortar test was 77% Blasting Gelatine.

I claim:

1. An aqueous slurry blasting explosive composition comprising an aqueous suspension of water-soluble crystalline oxidising salt consisting predominantly of ammonium nitrate, which salt has been comminuted in a saturated aqueous solution of said salt in the presence of a water-soluble crystal-growth inhibiting surfactant having a hydrophobic portion and a hydrophilic portion in its molecule, in intimate admixture with liquid water-immiscible hydrocarbon fuel sensitiser, the hydrocarbon fuel having been mixed with the aqueous suspension at a temperature below that at which all the oxidising salt dissolves in the solution.

2. A composition as claimed in claim 1 wherein the aqueous suspension contains from 10 to 40% by weight of water.

3. An explosive composition as claimed in claim 1 wherein the oxidising salt is comminuted to average particle diameter of less than 45 microns.

4. An explosive composition as claimed in claim 1 containing from 6 to 20% by weight of water and from 30 to 80% by weight of oxidising salt.

5. An explosive composition as claimed in claim 1 wherein the liquid hydrocarbon fuel is selected from the group consisting of benzene, toluene, xylene and fuel oil.

6. An explosive composition as claimed in claim 1 comprising from 1.5 to 5% by weight of liquid hydrocarbon fuel.

7. An explosive composition as claimed in claim 1 wherein the crystal-growth inhibiting surfactant is selected from the group consisting of water-soluble polysaccharide derivatives, long chain aliphatic amines wherein the aliphatic group contains more than 6 carbon atoms, polyacrylic acid, sulphonated nuclear aromatic compounds, sulphonated dyes, sulphonated polymers, long chain (C6 to C18) alkyl sulphonates, long chain (C6 to C18) alkyl phosphonates and mixtures of any two or more of these surfactants.

8. An explosive composition as claimed in claim 7 wherein the crystal-growth inhibiting surfactant is selected from the group consisting of sodium carboxymethyl cellulose, long chain aliphatic amines wherein the aliphatic group contains from 6 to 18 carbon atoms, sodium methyl naphthalene sulphonate, acid magenta and sodium lignosulphonate.

9. An explosive composition as claimed in claim 1 comprising additionally a deflocculant selected from the group consisting of water-soluble polysaccharide derivatives, polyacrylic acid, polyvinyl pyrrolidone, sodium lignosulphonate, salts of condensates of naphthalene sulphonic acid with formaldehyde and mixtures of any two or more of these deflocculants, the chemical nature of the deflocculant being different from that of the crystal-growth inhibiting surfactant.

10. An explosive composition as claimed in claim 9 wherein the deflocculant is selected from the group consisting of sodium carboxymethyl cellulose and the sodium salts of condensates of naphthalene sulphonic acid with formaldehyde.

11. An explosive composition as claimed in claim 9 wherein the surfactant/deflocculant combination is selected from the group consisting of sodium methyl naphthalene sulphonate/sodium carboxymethyl cellulose; sodium methyl naphthalene sulphonate/sodium salt of a condensate of naphthalene sulphonic acid with formaldehyde; sodium carboxymethyl cellulose/-sodium salt of a condensate of naphthalene sulphonic acid with formaldehyde; acid magenta/sodium salt of a condensate of naphthalene sulphonic acid with formaldehyde and sodium methyl naphthalene sulphonate/-sodium lignosulphonate.

12. An explosive composition as claimed in claim 1 wherein the surfactant is present in an amount in the range from 0.05 to 2.0% of the total weight of the comminuted oxidising salt.

13. An explosive composition as claimed in claim 9 wherein the deflocculant is present in an amount in the range from 0.05 to 2.0% of the total weight of the comminuted oxidising salt.

14. A method as claimed in claim 1 wherein the deflocculant is selected from the group consisting of water-soluble polysaccharide derivatives, polyacrylic acid, polyvinyl pyrrolidone, sodium lignosulphonate, salts of condensates of naphthalene sulphonic acid with formaldehyde and mixtures of any two or more of these deflocculants.

15. A method of preparing an aqueous slurry blasting explosive composition comprising the steps of comminuting water-soluble crystalline oxidising salt consisting predominantly of ammonium nitrate in a saturated aqueous solution of oxidising salt in the presence of a crystal-growth inhibiting surfactant having a hydrophobic portion and a hydrophilic portion in its molecule to form an aqueous suspension of comminuted oxidising salt and intimately mixing liquid water-immiscible hydrocarbon fuel sensitiser into the suspension at a temperature below that at which all the oxidising salt dissolves in the solution.

16. A method as claimed in claim 15 wherein the crystal-growth inhibiting surfactant is selected from the group consisting of water-soluble polysaccharide derivatives, long chain aliphatic amines wherein the aliphatic group contains more than 6 carbon atoms, polyacrylic acid, sulphonated nuclear aromatic compounds, sulphonated dyes, sulphonated polymers, long chain (C6 to C18) alkyl sulphonates, long chain (C6 to C18) alkyl phosphonates and mixtures of any two or more of these surfactants.

17. A method as claimed in claim 15 wherein a deflocculant is added to the aqueous suspension of comminuted oxidising salt, the chemical nature of the deflocculant being different from that of the crystal-growth inhibiting surfactant.

18. A method as claimed in claim 17 wherein the deflocculant is selected from the group consisting of water-soluble polysaccharide derivatives, polyacrylic acid, polyvinyl pyrrolidone, sodium lignosulphonate, salts of condensates of naphthalene sulphonic acid with formaldehyde and mixtures of any two or more of these deflocculants.

* * * * *